US011076248B2

(12) United States Patent
Holter et al.

(10) Patent No.: US 11,076,248 B2
(45) Date of Patent: Jul. 27, 2021

(54) HEADSET SYSTEM FAILURE DETECTION

(71) Applicant: Honeywell International Inc., Morris Plains, NJ (US)

(72) Inventors: Trym Holter, Trondheim (NO); Viggo Henriksen, Trondheim (NO); Jaromir Macak, Brno (CZ); Ingunn Amdal, Trondheim (NO)

(73) Assignee: Honeywell International Inc., Morris Plains, NJ (US)

( * ) Notice: Subject to any disclaimer, the term of this patent is extended or adjusted under 35 U.S.C. 154(b) by 194 days.

(21) Appl. No.: 16/097,110

(22) PCT Filed: Apr. 28, 2016

(86) PCT No.: PCT/US2016/029732
§ 371 (c)(1),
(2) Date: Oct. 26, 2018

(87) PCT Pub. No.: WO2017/188954
PCT Pub. Date: Nov. 2, 2017

(65) Prior Publication Data

US 2020/0359144 A1 Nov. 12, 2020

(51) Int. Cl.
*H04R 29/00* (2006.01)
*G10K 11/178* (2006.01)
(Continued)

(52) U.S. Cl.
CPC ..... *H04R 29/001* (2013.01); *G10K 11/17833* (2018.01); *G10L 21/0216* (2013.01);
(Continued)

(58) Field of Classification Search
CPC ..... H04R 1/1083; H04R 29/001; G10K 2210/1081; G10K 2210/503; G10K 11/17833; G10L 21/0216
(Continued)

(56) References Cited

U.S. PATENT DOCUMENTS 4,877,298 A 10/1989 Haigler
4,887,298 A 12/1989 Haigler
(Continued)

FOREIGN PATENT DOCUMENTS

CN 101547389 A 9/2009
CN 101765048 A 6/2010
(Continued)

OTHER PUBLICATIONS

International Application No. PCT/US2016/029732, International Search Report, dated Jan. 13, 2017, 3 pages.
(Continued)

*Primary Examiner* — Paul Kim
(74) *Attorney, Agent, or Firm* — Alston & Bird LLP

(57) ABSTRACT

A headset system comprises: a headset comprising at least one microphone and at least one speaker and configured to transmit and receive sound; a wire system coupled to the headset and comprising a wire; and a control unit coupled to the wire system and configured to: receive from the wire a combined signal comprising a first signal and a second signal, determine that the first signal is a spurious signal, and detect a failure of the wire system based on the determining.

18 Claims, 6 Drawing Sheets

(51) Int. Cl.
*G10L 21/0216* (2013.01)
*H04R 1/10* (2006.01)

(52) U.S. Cl.
CPC ... *H04R 1/1083* (2013.01); *G10K 2210/1081* (2013.01); *G10K 2210/503* (2013.01)

(58) Field of Classification Search
USPC ..... 381/74
See application file for complete search history.

(56) References Cited

U.S. PATENT DOCUMENTS

| | | | | |
|---|---|---|---|---|
| 6,456,199 | B1 | 9/2002 | Michael | |
| 6,567,524 | B1 | 5/2003 | Svean et al. | |
| 6,661,901 | B1 | 12/2003 | Svean et al. | |
| 6,728,385 | B2 | 4/2004 | Kvaloy et al. | |
| 6,754,359 | B1 | 6/2004 | Svean et al. | |
| 7,039,195 | B1 | 5/2006 | Svean et al. | |
| 7,139,537 | B2 | 11/2006 | Nakayama | |
| D601,241 | S | 9/2009 | Svean et al. | |
| 7,602,923 | B2 | 10/2009 | Lee et al. | |
| 8,090,112 | B2 | 1/2012 | Shuttleworth | |
| 8,101,103 | B2 | 1/2012 | Tiemens et al. | |
| 8,552,887 | B2 | 10/2013 | Sherwood et al. | |
| 9,554,733 | B2 | 1/2017 | Henriksen et al. | |
| 9,895,088 | B2 | 2/2018 | Henriksen et al. | |
| 10,311,401 | B2 | 6/2019 | Y et al. | |
| 2004/0202333 | A1 | 10/2004 | Csermak et al. | |
| 2007/0230715 | A1 | 10/2007 | Ingemi et al. | |
| 2009/0141906 | A1 | 6/2009 | Truesdell | |
| 2010/0272284 | A1* | 10/2010 | Joho ..... | G10K 11/17857 381/71.8 |
| 2011/0091047 | A1 | 4/2011 | Konchitsky et al. | |
| 2012/0328116 | A1* | 12/2012 | Bidmead ..... | H04R 29/004 381/59 |
| 2013/0187794 | A1 | 7/2013 | Sherwood et al. | |

FOREIGN PATENT DOCUMENTS

| | | | | |
|---|---|---|---|---|
| CN | 103929707 | A | 7/2014 | |
| CN | 104661170 | A | 5/2015 | |
| CN | 105188009 | A | 12/2015 | |
| EP | 1313417 | A1 | 5/2003 | |
| EP | 2793224 | A1 | 10/2014 | |
| EP | 3243172 | A1 | 11/2017 | |
| EP | 3335407 | A1 | 6/2018 | |
| JP | 2014-216704 | A | 11/2014 | |
| WO | 02/17836 | A1 | 3/2002 | |
| WO | WO-0217836 | A1 * | 3/2002 | ..... A61F 11/08 |
| WO | 2008082939 | A1 | 7/2008 | |
| WO | 2017188954 | A1 | 11/2017 | |

OTHER PUBLICATIONS

International Application No. PCT/US2016/029732, Written Opinion of the International Searching Authority, dated Jan. 13, 2017, 7 pages.
CN Office Action dated Apr. 14, 2020 for CN Application No. 201680087265.
CN Office Action, including Search Report, dated Nov. 6, 2019 for CN Application No. 201680087265.
Communication from the Examining Division dated Nov. 15, 2019 for EP Application No. 16900692.
Communication pursuant to Rules 70(2) and 70a(2) EPC dated Nov. 12, 2019 for EP Application No. 16900692.
English Translation of CN Office Action dated Apr. 14, 2020 for CN Application No. 201680087265.
English Translation of CN Office Action, including Search Report, dated Nov. 6, 2019 for CN Application No. 201680087265.
European Search Report and Search Opinion Received for EP Application No. 16900692.1, dated Oct. 25, 2019, 9 pages.
CN Notice of Allowance dated Jan. 21, 2021 for CN Application No. 201680087265, 2 pages.
CN Office Action dated Aug. 10, 2020 for CN Application No. 201680087265, 4 pages.
English translation of CN Notice of Allowance dated Jan. 21, 2021 for CN Application No. 201680087265, 3 pages.
English Translation of CN Office Action dated Aug. 10, 2020 for CN Application No. 201680087265, 7 pages.

* cited by examiner

HEADSET SYSTEM FAILURE DETECTION

CROSS-REFERENCE TO RELATED APPLICATIONS

The present application is the National Stage of International Application No. PCT/US2016/029732, filed Apr. 28, 2016 in the United States Receiving Office and entitled "Headset System Failure Detection" which is hereby incorporated by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A sound wave is a pressure wave comprising alternating periods of compression and rarefaction. Active noise reduction (ANR), which may be referred to as noise cancellation or control (ANC), uses two sound waves. A first sound wave is an undesired sound wave, which may be referred to as noise. A second sound wave has the same amplitude as the first wave, but with a phase that is inverted compared to the phase of the first wave. The first sound wave and the second sound wave combine and undergo destructive interference, effectively cancelling each other out.

ANR is particularly important in high-noise environments such as construction, manufacturing, aircraft, and military combat areas. Those areas may experience loud sounds, which can damage the human ear and disrupt communication among people. It is therefore desirable to provide ANR that allows for safety and reliable communication.

SUMMARY

In one embodiment, the disclosure includes a headset system comprising: a headset comprising at least one microphone and at least one speaker and configured to transmit and receive sound; a wire system coupled to the headset and comprising a wire; and a control unit coupled to the wire system and configured to: receive from the wire a combined signal comprising a first signal and a second signal, determine that the first signal is a spurious signal, and detect a failure of the wire system based on the determining.

In another embodiment, the disclosure includes a headset system comprising: a headset comprising: a first outer microphone, a first inner microphone, and a first speaker; a wire system coupled to the headset and comprising: a first power supply wire configured to provide power to the headset, a first outer microphone wire configured to provide communication to and from the first outer microphone, a first inner microphone wire configured to provide communication to and from the first inner microphone, and a first speaker wire configured to provide communication to and from the first speaker; and a control unit coupled to the wire system and configured to detect for a failure in the first power supply wire, the first outer microphone wire, the first inner microphone wire, and the first speaker wire.

In yet another embodiment, the disclosure includes a method implemented in a headset system, the method comprising: receiving environmental sound from an outside environment; receiving spoken sound from a human voice present in front of an ear drum; converting the environmental sound to a first electrical signal; converting the spoken sound to a second electrical signal; processing the first electrical signal and the second electrical signal; and determining whether the first electrical signal, the second electrical signal, or a combination of the first electrical signal and the second electrical signal is mixed with a spurious signal.

These and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that, although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein are embodiments for headset system failure detection. A headset system detects failures in power supply wires, outer microphone wires, inner microphone wires, and speaker wires by distinguishing between spurious signals and aural-origin (AO) signals. The system uses available signals that are processed during normal operation. In other words, the system need not introduce signals in order to detect failures. Upon detecting failures, the system may disable features such as ANR for safety and other purposes.

Figure 1:
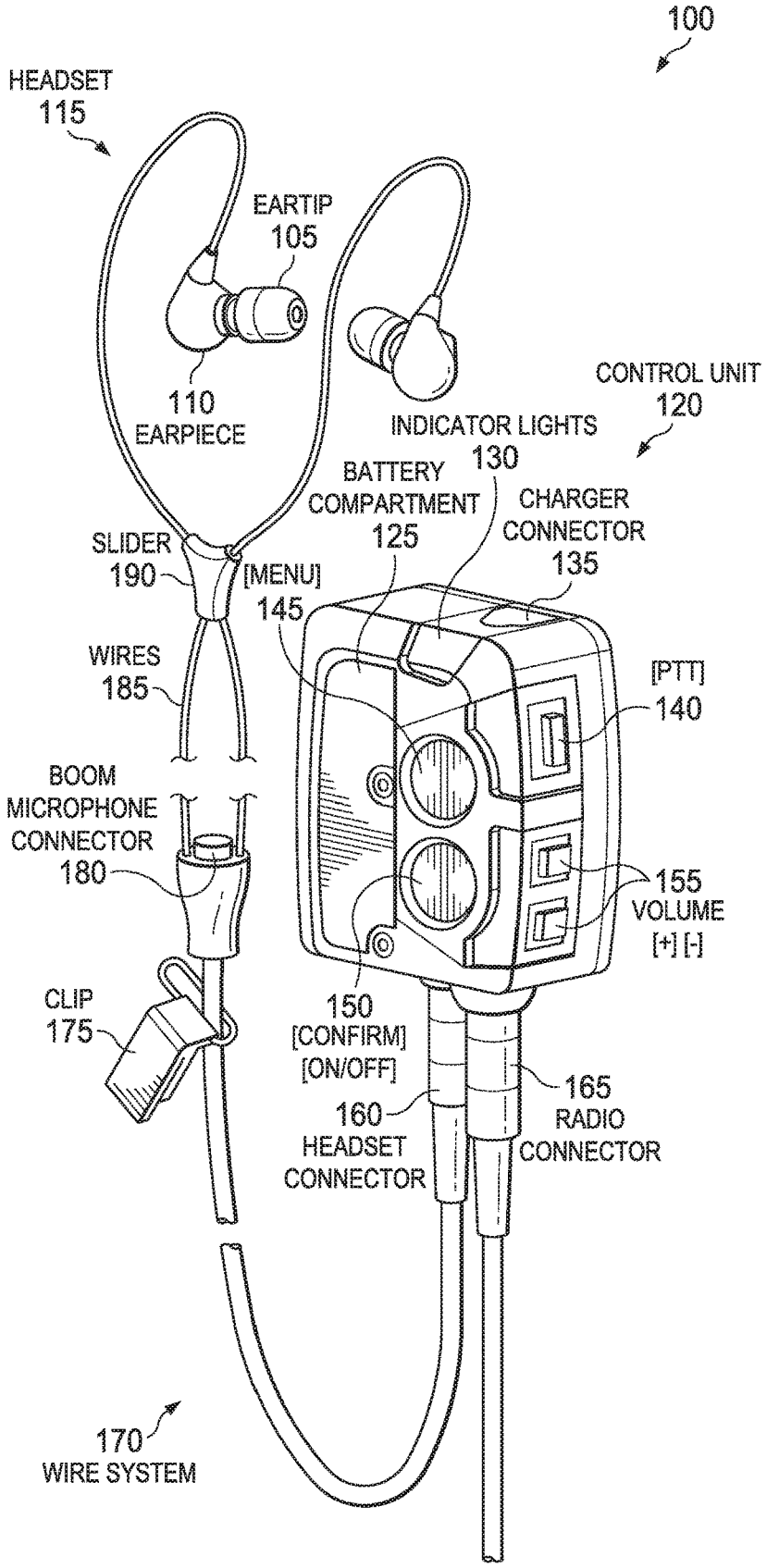
FIG. 1 is a schematic diagram of a headset system.

FIG. 1 is a schematic diagram of a headset system 100. The system 100 generally comprises a headset 115, a control unit 120, and a wire system 170. The system 100 connects to a radio. The radio may instead be a Moving Picture Experts Group (MPEG)-1 or MPEG 2 Audio Layer III (MP3) player or another audio source that provides external sound.

The headset 115 comprises eartips 105 and earpieces 110. The eartips 105 allow the headset 115 to secure into a user's ear. The eartips 105 comprise foam, which provides high attenuation for sufficient hearing protection. The eartips 105 also comprise two sound ports, which transfer sound between transducers in the earpieces 110 and the ear canals. A fit test of the system 100 alerts the user if the eartips 105 are not properly inserted in the user's ear canals. The headset 115 and specifically the earpieces 110 are described further below with respect to FIG. 2

The control unit 120 comprises a battery compartment 125, indicator lights 130, a charger connector 135, a push-to-talk (PT) button 140, a menu button 145, a confirm and on/off button 150, and a volume button 155. The battery compartment 125 provides a housing for a battery and comprises a ventilation filter to keep the battery cool. The indicator lights 130 support a user interface. For instance, the indicator lights 130 light up in different situations as follows:

| Color: | Indication: |
|---|---|
| green | low noise dose |
| yellow | medium noise dose |
| red | high noise doses |
| green | high battery life |
| yellow | medium battery life |
| red | low battery life |
| green pulsing | user action succeeded |
| yellow pulsing | action is running |
| red pulsing | warning (with explanatory voice message) |
| green, yellow, and red flash | system is shutting down |

A noise dose refers to a measure of a sound amplitude and may be in units of decibels (dB) or A-weighted decibels (dBA). In this context, dose exposure refers to a noise dose on the inside of the earpiece 110. The control unit 120 measures dose exposure for protection of the user. The charger connector 135 provides a port to plug in a charging cable, which charges the battery. The PT button 140 provides a radio functionality so that the user can press and hold the PTT button 140 to transmit data and can release the PTT button 140 to receive data. The menu button 145 initiates a menu upon being pressed, voice feedback presents menu options, and the menu button 145 cycles to subsequent menu options upon being pressed again. The confirm and on/off button 150 turns on the system 100 upon being pushed and held in place for two seconds and turns off the system 100 upon being pushed and held for three seconds. Upon being pushed, the confirm and on/off button 150 also selects a menu option and initiates a sub-menu if available. The volume button 155 provides plus and minus buttons, which respectively increase and decrease voice feedback volume, ambient sound volume, and radio volume.

The wire system 170 comprises a headset connector 160, a radio connector 165, a clip 175, a boom microphone connector 180, wires 185, and a slider 190. The headset connector 160 connects the headset 115 to the control unit 120 via the wire system 170. The radio connector 165 connects the radio to the control unit 120 via the wire system 170. The clip 175 removes tension from the wire system 170 and secures the system 100 to a shirt or another article of clothing. The boom microphone connector provides a connection for an option boom microphone, which may improve outgoing communication quality using additional ANR. The wires 185 comprise an outer microphone wire, an inner microphone wire, a speaker wire, and a power supply wire for both a left ear side and a right ear side. The wires 185 communicate signals between the headset 115 and the control unit 120. The slider 190 moves up and down the wire system 170 to loosen or tighten the wire system 170 above and below the slider 190.

Figure 2:
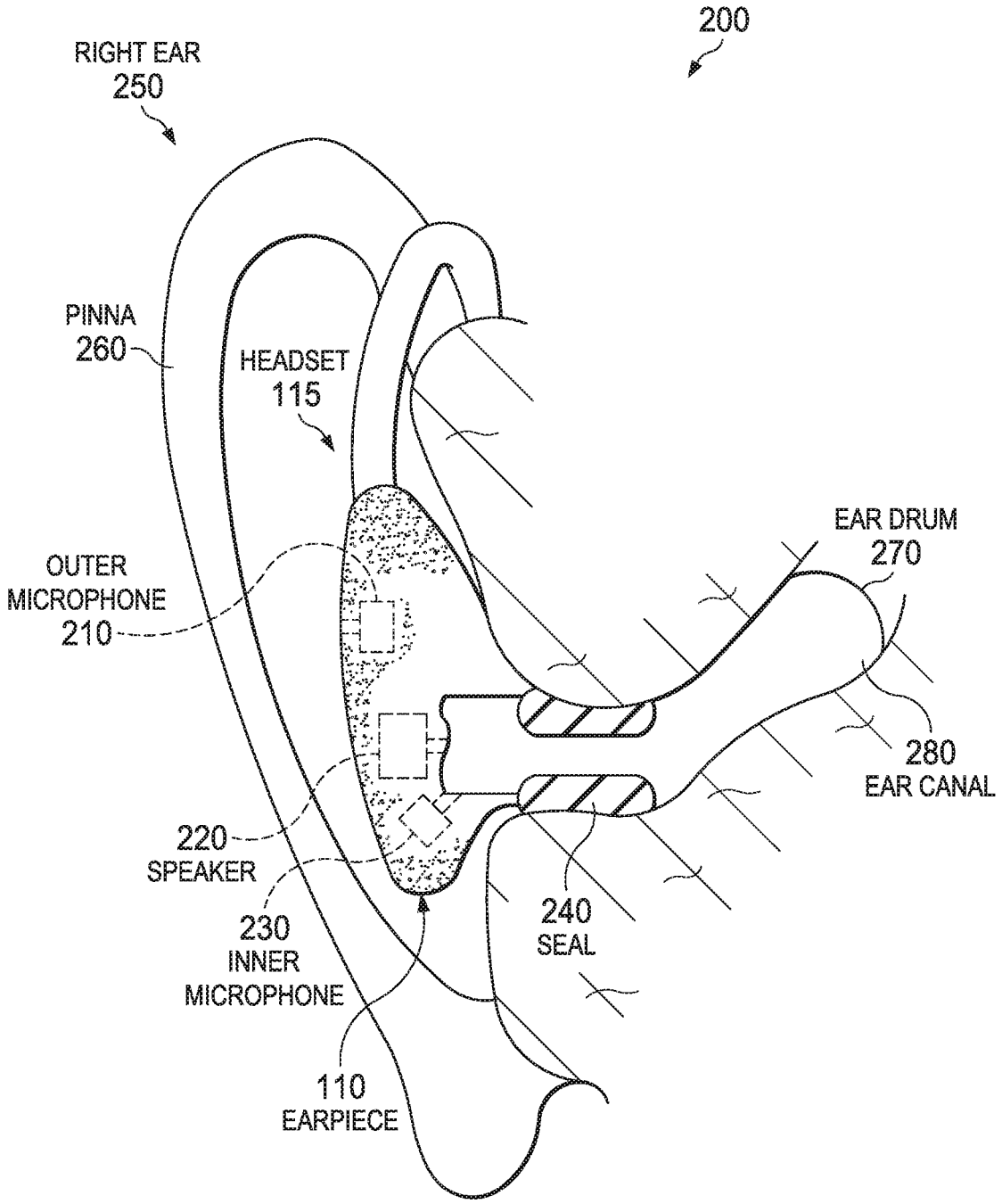
FIG. 2 is a schematic diagram of the headset in FIG. 1 fitted in and on a right ear.

FIG. 2 is a schematic diagram 200 of the headset 115 in FIG. 1 fitted in and on a right ear 250. The headset 115 has the same components for a left ear. FIG. 2 shows that the right ear 250 comprises a pinna 260, an ear drum 270, and an ear canal 280. In addition, FIG. 2 shows that the earpiece 110 comprises an outer microphone 210, a speaker 220, an inner microphone 230, and seals 240 and that the earpiece 110 is fitted within the ear canal 280 and directed to the ear drum 270.

The outer microphone 210 receives environmental sound from an outside environment, which may also be referred to as ambient sound. The outer microphone 210 couples to the control unit 120 via the outer microphone wire. The speaker 220 transmits to the user's ear canals an optimal mix of environmental sound and sound from the radio. The speaker 220 couples to the control unit 120 via the speaker wire. The inner microphone 230 performs voice pick-up, which is receiving spoken sound from a human voice present in front of an ear drum, thus enabling radio communication without an external microphone. The inner microphone 230 couples to the control unit 120 via the inner microphone wire. The seals 240 seal off the ear canal 280 from ambient noise. The power supply wire provides power to the headset 115 via a power supply in the control unit 120. The power supply is described further below with respect to FIG. 3.

Figure 3:
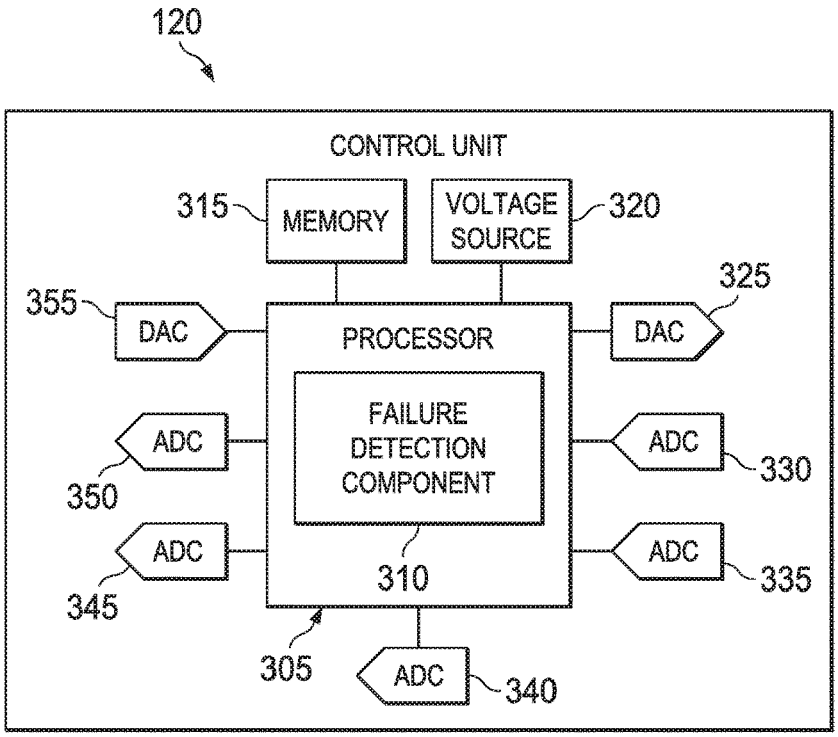
FIG. 3 is a schematic diagram of the control unit in FIG. 1 according to an embodiment of the disclosure.

FIG. 3 is a schematic diagram of the control unit 120 in FIG. 1 according to an embodiment of the disclosure. FIG. 3 shows that the control unit 120 comprises a processor 305; a memory 315; a voltage source 320; digital-to-analog converters (DACs) 325, 355; and analog-to-digital converters (ADCs) 330, 335, 345, 350. The control unit 120 is shown in a simplified manner, but may be designed in any manner suitable for implementing the disclosed embodiments.

The processor 305 may be a microprocessor, logic unit, or central processing unit (CPU). The processor processes data from the memory 315; the DACs 325, 355; and the ADCs 330, 335, 345, 350. The processor 305 is implemented by any suitable combination of hardware, middleware, firmware, and software. The processor 305 may be implemented as one or more CPU chips, cores (e.g., as a multi-core processor), field-programmable gate arrays (FPGAs), application specific integrated circuits (ASICs), and digital signal processors (DSPs). The processor 305 comprises a failure detection component 310. The failure detection component 310 implements the disclosed embodiments described above. The inclusion of the failure detection component 310 therefore provides a substantial improvement to the functionality of the control unit 120 and effects a transformation of the control unit 120 to a different state. Alternatively, the failure detection component 310 is implemented as instructions stored in the memory 315 and executed by the processor 305.

The memory 315 comprises one or more disks, tape drives, and solid-state drives and may be used as an overflow data storage device, to store programs when such programs are selected for execution, and to store instructions and data that are read during program execution. The memory 315 may be volatile and non-volatile and may be read-only memory (ROM), random-access memory (RAM), ternary content-addressable memory (TCAM), and static random-access memory (SRAM).

The voltage source 320 provides a voltage to power the headset 115 and its components via the power supply wires. The DACs 325, 355 receive digital signals from the processor 305, convert the digital signals into analog signals, and provide the analog signals to the speakers via the speaker wires. The ADCs 330, 350 receive analog signals from the inner microphones 230 via the inner microphone wires, convert the analog signals into digital signals, and provide the digital signals to the processor 305. The ADCs 335, 345 receive analog signals from the outer microphones 210 via the outer microphone wires, convert the analog signals into digital signals, and provide the digital signals to the processor 305. The ADC 340 receives analog signals from the radio via a radio wire, converts the analog signals into digital signals, and provides the digital signals to the processor 305.

In operation, the outer microphone 210 captures environmental sound, the control unit 120 analyzes the environmental sound, and the speaker 220 reproduces the environmental sound at a safe level. With ANR activated, the inner microphone 230 captures a noise signal, the control unit 120 produces an appropriate inverted signal to destructively interfere with the noise signal, and the speaker 220 emits the inverted signal. The inverted signal therefore reduces the noise level. The control unit 120 also performs a fit test to ensure that the eartips 105 are properly inserted and that a minimum level of attenuation is achieved. If that minimum level of attenuation is not achieved, then the control unit 120 generates voice feedback, which the speaker 220 emits.

A spurious signal, which may also be referred to as a failure signal or a transient signal, is an electrical wave whose origin is an undesired electrical event. A spurious signal is typically short and does not occur due to normal functioning of a device such as the system 100. Rather, a spurious signal occurs as a result of a failure and generates at the point of the failure. In this context, the point of the failure is in the system 100. The origin of a spurious signal is not an aural event. Thus, a spurious signal is a type of non-aural (NA) signal. In contrast, an AO signal is a sound wave whose origin is an aural event. For instance, an AO signal results from a person speaking or a door closing. An AO signal is immediately audible to a person. A device such as the outer microphones 210 and the inner microphones 230 may then convert the AO signal from a sound wave to an electrical wave or electrical signal.

In order to properly provide ANR, communication, and dose exposure monitoring, the outer microphones 210, the speakers 220, and the inner microphones 230 need to cooperate correctly. The wires 185, including the outer microphone wires, inner microphone wires, speaker wires, power supply wires, may fail over time due to pressure, flexion, and general degradation. A failure of the wires 185 may cause the outer microphones 210 and the inner microphones 230 to fail. Such a failure may generate a spurious signal in the outer microphone wires, the inner microphone wires, or both. The spurious signal may cause a further failure of the ANR, communication, and dose exposure monitoring. As a result, the system 100 may generate sounds that are dangerous to human hearing.

Figure 4:
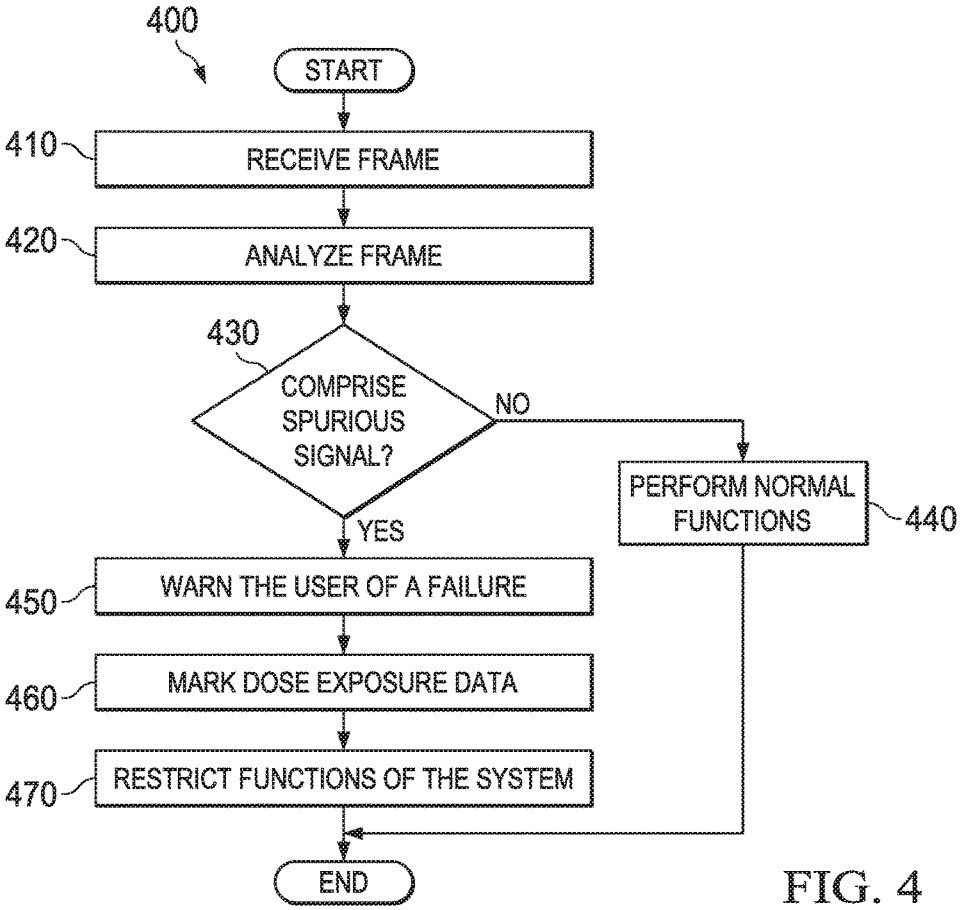
FIG. 4 is a flowchart illustrating a method of signal analysis and failure response according to an embodiment of the disclosure.

FIG. 4 is a flowchart illustrating a method 400 of signal analysis and failure response according to an embodiment of the disclosure. The system 100 and the processor 305, specifically the failure detection component 310, implement the method 400. At step 410, the failure detection component 310 receives a frame. The frame represents a period of data corresponding to a signal or signals. Though step 410 describes a single frame, the method 400 applies to any number of frames. The failure detection component 310 receives the frame from at least one of the outer microphone wires or the inner microphone wires. One frame may comprise no signals representing sound while a subsequent frame may comprise such signals. In other words, some frames may correlate to periods of quiet. Each frame comprises a number of samples indicating data points at a specific time. At step 420, the failure detection component 310 analyzes the frame. That analysis is described further below. At decision diamond 430, the failure detection component 310 determines whether the frame comprises a spurious signal.

If the result of decision diamond 430 is no, then the method 400 proceeds to step 440. Finally, at step 440, the failure detection component 310 causes the system 100 to perform its normal functions. If the result of decision diamond 430 is yes, then the method 400 proceeds to step 450. At step 450, the failure detection component 310 warns the user of a failure. The user may then choose to turn off the system 100 or restrict or disable some functions of the system 100 such as ANR. At step 460, the failure detection component 310 marks dose exposure data. Specifically, the failure detection component 310 marks dose exposure data associated with the spurious signal in order to subsequently distinguish the dose exposure from the spurious signal and the dose exposure from desired AO signals. Finally, at step 470, the failure detection component 310 restricts or disables functions of the system 100. For instance, the failure detection component 310 restricts or disables ANR because ANR may require that the system 100 be failure-less in order for the ANR to function properly. The failure detection component 310 may also restrict or disable the voice pick-up function or another function, or the failure detection component 310 may disable individual components such as the outer microphone 210, the speaker 220, or the inner microphone 230 for either ear or for both ears. If the failure detection component 310 restricts or disables components for one ear, then the failure detection component 310 may direct functionality to the corresponding components in the other ear. Alternatively, the failure detection component 310 turns off the system 100. Though the method 400 is shown as analyzing and responding to a single frame, the system 100, the processor 305, and the failure detection component 310 may perform the method 400 for any number of frames.

When a spurious signal is generated in the system 100, the outer microphone wires, the inner microphone wires, or both communicate a combined signal comprising both the spurious signal and a desired AO signal such as environmental sound. The system 100 uses available signals that are processed during normal operation. In other words, the system 100 need not introduce signals in order to detect failures. The failure detection component 310 analyzes the combined signal in the time domain for features such as peak values. If a peak value is higher than a pre-determined threshold, then the failure detection component 310 may determine that there is a failure. The failure detection component 310 uses C-weighted data to strengthen low-frequency content that is typical for spurious signals. A peak localization algorithm looks for a spurious signal peak at the same time in two frames, one frame for an outer microphone wire and another frame for an inner microphone wire. A spurious signal peak at the same time in both frames indicates a power supply wire failure.

The failure detection component 310 may implement various functions to reduce or eliminate false alarms, which in this case are detections of spurious signals when there are no actual spurious signals present in the system 100. First, the failure detection component 310 stores and accumulates markers. When the failure detection component 310 discovers a first spurious signal indicating a failure, it stores a first marker. When the failure detection component 310 discovers a second spurious signal at a subsequent time, particularly if the second spurious signal is similar to the first spurious signal, the failure detection component 310 stores a second marker. The failure detection component 310 responds to spurious signals upon accumulation of a pre-determined number of markers. Second, the failure detection component 310 disables its failure detection when the average sound pressure levels of signals from the outer microphone 210 are above a threshold. The failure detection component 310 does so because it could otherwise confuse loud environmental noise with spurious signals. Third, the failure detection component 310 analyzes signals from the wires 185 from both the left ear and the right ear. Fourth, the failure detection component 310 disables its failure detection when the fit test indicates that the eartips 105 are not properly inserted in the user's ear canals. Fifth, the failure detection component 310 disables its failure detection when the radio provides signals to the system 100 because those signals could negatively affect the failure detection. Sixth, the failure detection component 310 disables its failure detection when it detects an external microphone because the microphone could negatively affect the failure detection. The failure detection component 310 may generate flags upon detecting an improper fit, radio signals, or the external microphone.

The failure detection component 310 determines which of the wires 185 is failing based on unique characteristics of those failures, which generate spurious signals. Specifically, a power supply wire failure affects signals from both the respective outer microphone wire and the respective inner microphone wire and is audible to the user due to the hear-through function of the system 100. In this context, the term "respective" indicates either a left ear side or a right ear side. For instance, a left ear power supply wire failure affects signals from both the left ear outer microphone wire and the left ear inner microphone wire. An outer microphone wire failure affects signals from only the respective outer microphone wire and is also audible to the user due to the hear-through function of the system 100. An inner microphone wire failure affects signals from only the respective inner microphone wire and is not audible to the user. Radio transmissions from the system 100 to a separate receiving device are based on signals that the inner microphone wires receive. Thus, inner microphone wire failures during such radio transmissions are audible to the receiving device. A speaker wire failure causes a low-level spurious signal that is clearly audible to the user. The respective inner microphone 230 receives the spurious signal and passes it to the respective inner microphone wire. Two methods for distinguishing between failures of the power wires and failures of the microphone and the speaker wires are described below.

Figure 5:
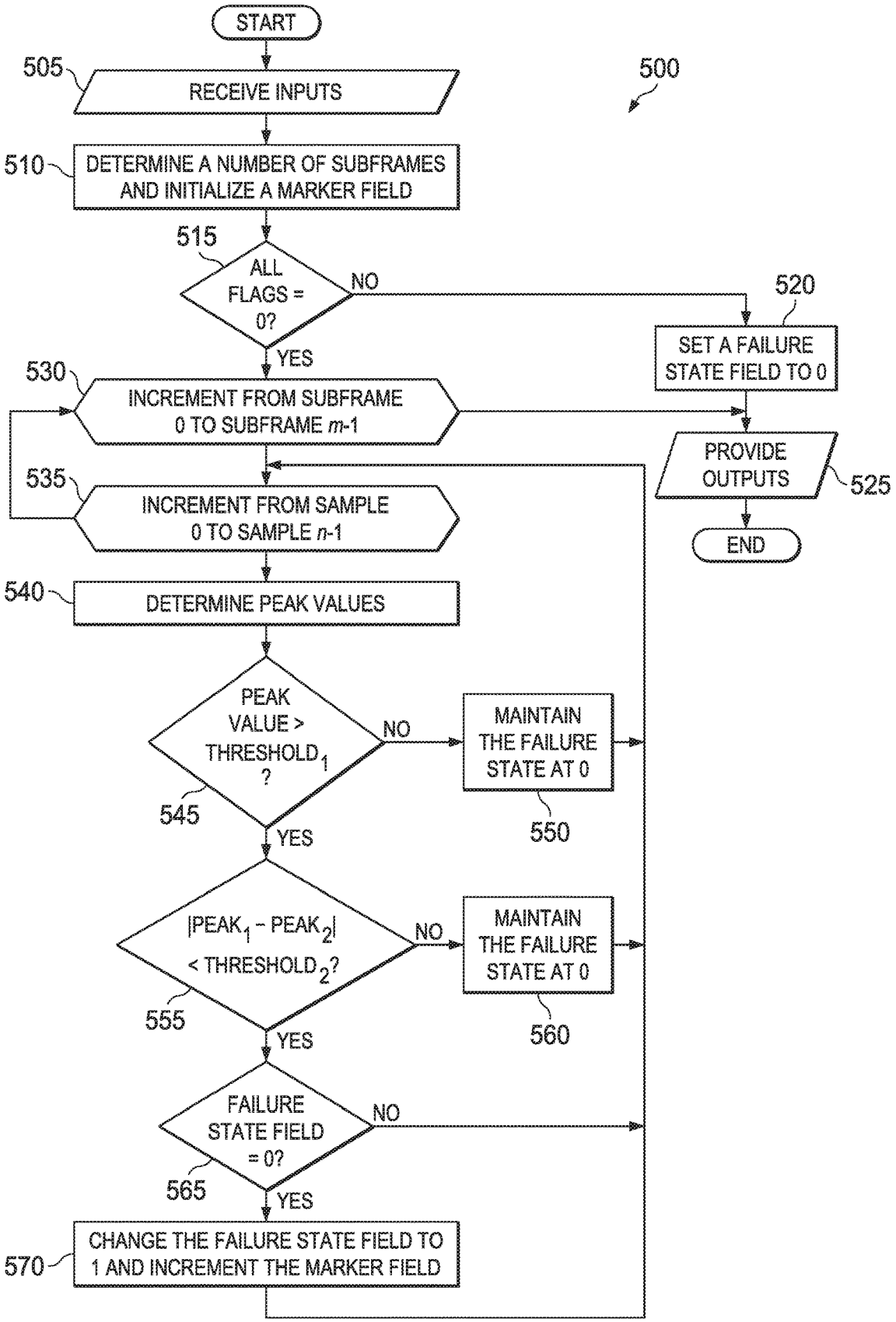
FIG. 5 is a flowchart illustrating a method of power supply wire failure detection according to an embodiment of the disclosure.

FIG. 5 is a flowchart illustrating a method 500 of power supply wire failure detection according to an embodiment of the disclosure. The system 100 and the processor 305, specifically the failure detection component 310, implement the method 500 for both the outer microphone wire and the inner microphone wire of either the left ear or the right ear. Generally, the method 500 determines whether a signal peak exists at the same time in both the outer microphone wire and the inner microphone wire. Though the method 500 simultaneously analyzes the outer microphone wire and the inner microphone wire, the method 500 may sequentially analyze the outer microphone wire and the inner microphone wire.

At step 505, the failure detection component 310 receives inputs. Specifically, the failure detection component 310 receives signals from both the outer microphone wire and the inner microphone wire and receives a failure state field, a flags field, and any other suitable parameters. The failure state field indicates whether the failure detection component 310 has detected a failure in the past. The flags field indicates whether flags exist for detection of an improper fit, radio signals, or the external microphone.

At step 510, the failure detection component 310 determines a number of subframes by dividing a frame size by a pre-determined subframe size. In this case the frame comprises m subframes, and each subframe comprises n samples. In addition, the failure detection component 310 initializes a marker field at 0, indicating that the failure detection component 310 has not yet stored a marker. The failure detection component 310 does so for the first pass through the method 500 and after the failure detection component 310 inspects and resets the marker field. The marker field indicates a number of times that the failure detection component 310 has stored a marker after detecting a failure.

At decision diamond 515, the failure detection component 310 determines whether all flags are set to 0. If the result of decision diamond 515 is no, then the method 500 proceeds to step 520. This is because a flag value of 1 indicates that the processor 305 has detected an improper fit, radio signals, or the external microphone, which could affect the failure detection. At step 520, the failure detection component 310 sets the failure state field to 0, indicating that the failure detection component 310 has not detected a failure. Finally, at step 525, the failure detection component 310 provides outputs. Specifically, the failure detection component 310 provides the failure state field and the marker field. In this case, the value of the failure state field is 0, indicating that the failure detection component 310 has not detected a failure, and the marker field is 0, indicating that the failure detection component 310 has not stored a marker.

If the result of decision diamond 515 is yes, then the method 500 proceeds to step 530. At step 530, the failure detection component 310 iterates from subframe 0 to subframe m−1 within the inspected frame. At step 535, the failure detection component 310 iterates from sample 0 to sample n−1. The failure detection component 310 performs the subsequent steps for each increment at steps 530 and 535. Once the increment at step 530 reaches subframe m, the method 500 proceeds to step 525.

At step 540, the failure detection component 310 determines peak values. The failure detection component 310 does so for samples from both the outer microphone wire and the inner microphone wire. The peak values indicate potential spurious signals. At decision diamond 545, the failure detection component 310 determines if any peak value is greater than a first threshold, $threshold_1$. The failure detection component 310 may store $threshold_1$ based on user input or a pre-determined design value. If the result of decision diamond 545 is no, then the method 500 proceeds to step 550. At step 550, the failure detection component 310 maintains the failure state at 0. The method 500 then proceeds to steps 535 and 530. If the result of decision diamond 545 is yes, then the method 500 proceeds to decision diamond 555.

At decision diamond 555, the failure detection component 310 determines if an absolute value of a difference between peak values is less than a second threshold, $threshold_2$. Specifically, the failure detection component 310 compares peak values that exist in both an outer microphone wire subframe and an inner microphone wire subframe, which may be referred to as $peak_1$ and $peak_2$. The failure detection component 310 determines a difference between $peak_1$ and $peak_2$, an absolute value of that difference, and whether the absolute value is less than $threshold_2$, thus indicating a similar peak value. The failure detection component 310 may store $threshold_2$ based on user input or a pre-determined design value. If the result of decision diamond 555 is no, then the method 500 proceeds to step 560. At step 560, the failure detection component 310 maintains the failure state at 0. The method 500 then proceeds to steps 535 and 530. If the result of decision diamond 555 is yes, then the method 500 proceeds to decision diamond 565. A yes result at decision diamond 555 indicates a close correlation in peak values in a signal from the outer microphone wire and a signal from the inner microphone wire. As mentioned above, a power supply wire failure affects signals from both the outer microphone wire and the inner microphone wire, so the close correlation indicates a power supply wire failure.

At decision diamond 565, the failure detection component 310 determines if the failure state is equal to 0. If the result of decision diamond 565 is no, then the method 500 proceeds to steps 535 and 530. A result of no indicates that the spurious signal is spread over more subframes or frames. Thus, the failure detection component 310 does not increment the marker field for the same spurious signal. If the result of decision diamond 565 is yes, then the method 500 proceeds to step 570. At step 570, the failure detection component 310 changes the failure state field to 1 and increments the marker field, indicating the presence of a spurious signal and a power supply wire failure. The method 500 then proceeds to steps 535 and 530.

Figure 6:
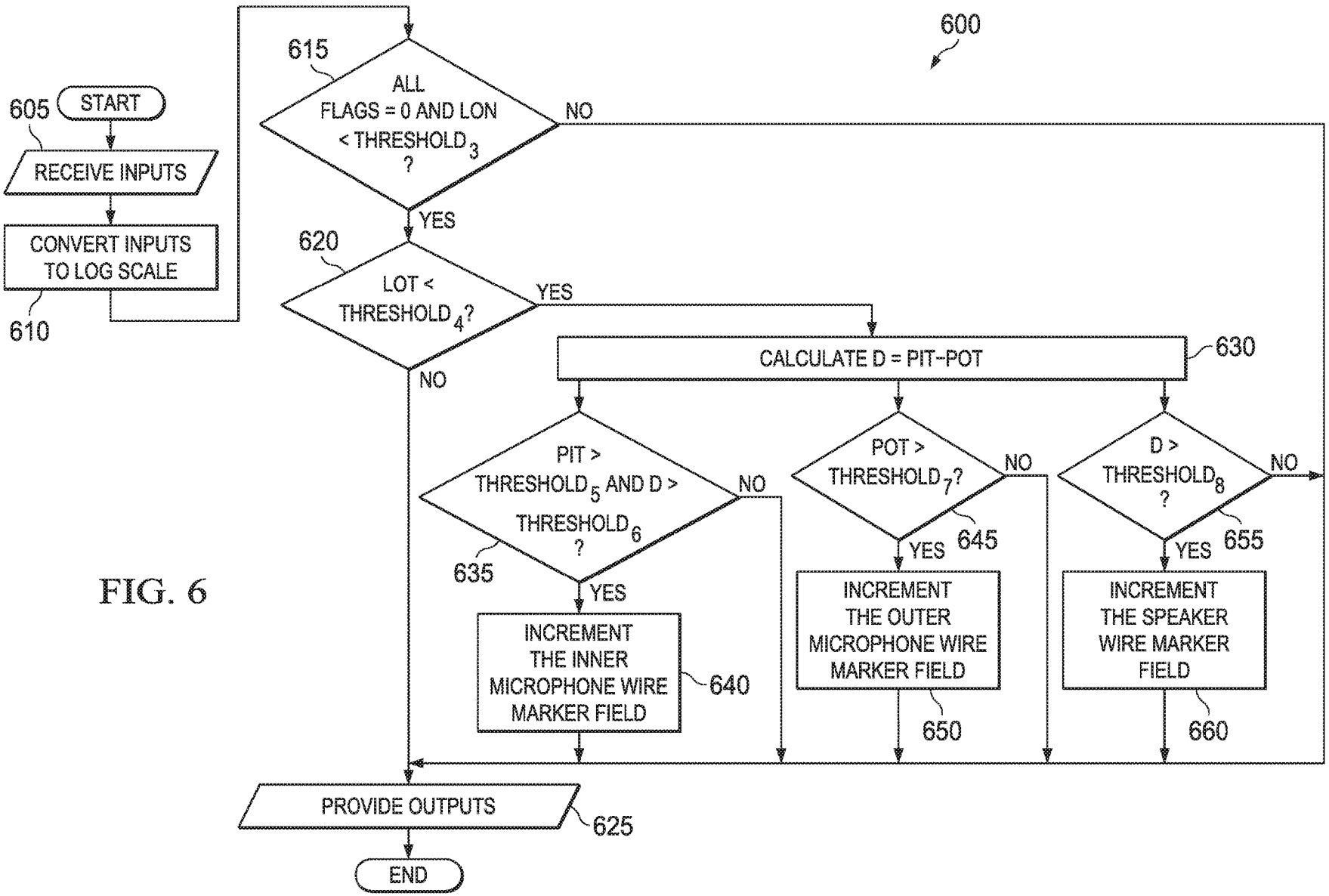
FIG. 6 is a flowchart illustrating a method of outer microphone wire, inner microphone wire, and speaker wire failure detection according to an embodiment of the disclosure.

FIG. 6 is a flowchart illustrating a method 600 of outer microphone wire, inner microphone wire, and speaker wire failure detection according to an embodiment of the disclosure. The system 100 and the processor 305, specifically the failure detection component 310, implement the method 600 to analyze the outer microphone wire, the inner microphone wire, and the speaker wire of either the left ear or the right ear using signals from the wires 185 from both ears. In this example, the term "peak" and its initial "P" indicate a peak value in a frame after filtering, the term "outer" and its initial "O" indicate the outer microphone wire, the term "inner" and its initial "I" indicate the inner microphone wire, the term "test" and its initial "T" indicate an ear side being tested, the term "non-test" and its initial "N" indicate an ear side not being tested, and the term "equivalent level" and its initial "L" indicate an equivalent level of a signal. An equivalent level of a signal is equal to an average sound pressure level of a period of time, which may typically be about one minute, but may also be any suitable length. Generally, the method 600 determines whether a signal peak exists in either the outer microphone wire or the inner microphone wire not due to environmental sound.

At step 605, the failure detection component 310 receives inputs. Specifically, the failure detection component 310 receives a PIT value, which is a peak value from the inner microphone wire being tested; a POT value, which is a peak value from the outer microphone wire being tested; an LOT value, which is an equivalent level value from the outer microphone wire being tested; an LON value, which is an equivalent level value from the outer microphone wire not being tested; and a flags field. The inputs may be C-weighted, A-weighted, or non-weighted. At step 610, the failure detection component 310 converts all the input values to a logarithmic scale. The input values in subsequent steps all refer to the input values after that calculation.

At decision diamond 615, the failure detection component 310 determines whether all flags are set to 0 and whether the LON value is less than a threshold, $threshold_3$. The failure detection component 310 may store $threshold_3$ based on user input or a pre-determined design value. If the result of decision diamond 615 is no, then the method 600 proceeds to step 625. The method 600 does so because a high LON value indicates significant environmental sound that could distort the detection of failures. At step 625, the failure detection component 310 provides outputs. Specifically, the failure detection component 310 provides an outer microphone wire marker field, an inner microphone wire marker field, and a speaker wire marker field, which indicate whether the respective components may have failures. In this case, the markers have values of 0, indicating that the failure detection component 310 has not detected a failure. If the result of decision diamond 615 is yes, then the method 600 proceeds to decision diamond 620.

At decision diamond 620, the failure detection component 310 determines whether the LOT value is less than a threshold, $threshold_4$. The failure detection component 310 may store $threshold_4$ based on user input or a pre-determined design value. A LOT value greater than $threshold_4$ indicates significant environmental sound that could distort the detection of failures. If the result of decision diamond 620 is no, then the method 600 proceeds to step 625. If the result of decision diamond 620 is yes, then the method 600 proceeds to step 630. At step 630, the failure detection component 310 calculates a difference value D, which is equal to a difference between the PIT value and the POT value. From step 630, the method 600 proceeds to decision diamond 635, decision diamond 645, and decision diamond 655.

At decision diamond 635, the failure detection component 310 determines whether the PIT value is greater than a threshold, $threshold_5$, and the difference D is greater than a threshold, $threshold_6$. A PIT value greater than $threshold_5$ and a D value greater than $threshold_6$ indicates a potential spurious signal in the inner microphone wire. The failure detection component 310 may store $threshold_5$ and $threshold_6$ based on user input or pre-determined design values. If the result of decision diamond 635 is no, then the method 600 proceeds to step 625. If the result of decision diamond 635 is yes, then the method 600 proceeds to step 640. At step 640, the failure detection component 310 increments the inner microphone wire marker field. The method 600 then proceeds to step 620.

At decision diamond 645, the failure detection component 310 determines whether the POT value is greater than a threshold, $threshold_7$. The failure detection component 310 may store $threshold_7$ based on user input or a pre-determined design value. A POT value greater than $threshold_7$ indicates a potential spurious signal in the outer microphone wire. If the result of decision diamond 645 is no, then the method 600 proceeds to step 620. If the result of decision diamond 645 is yes, then the method 600 proceeds to step 650. At step 650, the failure detection component 310 increments the outer microphone wire marker field. The method 600 then proceeds to step 620.

At decision diamond 655, the failure detection component 310 determines whether the difference D is greater than a threshold, $threshold_8$. The failure detection component 310 may store $threshold_8$ based on user input or a pre-determined design value. A D value greater than $threshold_8$ indicates a potential spurious signal in the speaker wire. If the result of decision diamond 655 is no, then the method 600 proceeds to step 620. If the result of decision diamond 655 is yes, then the method 600 proceeds to step 650. At step 650, the failure detection component 310 increments the speaker wire marker field. The method 600 then proceeds to step 620.

Figure 7:
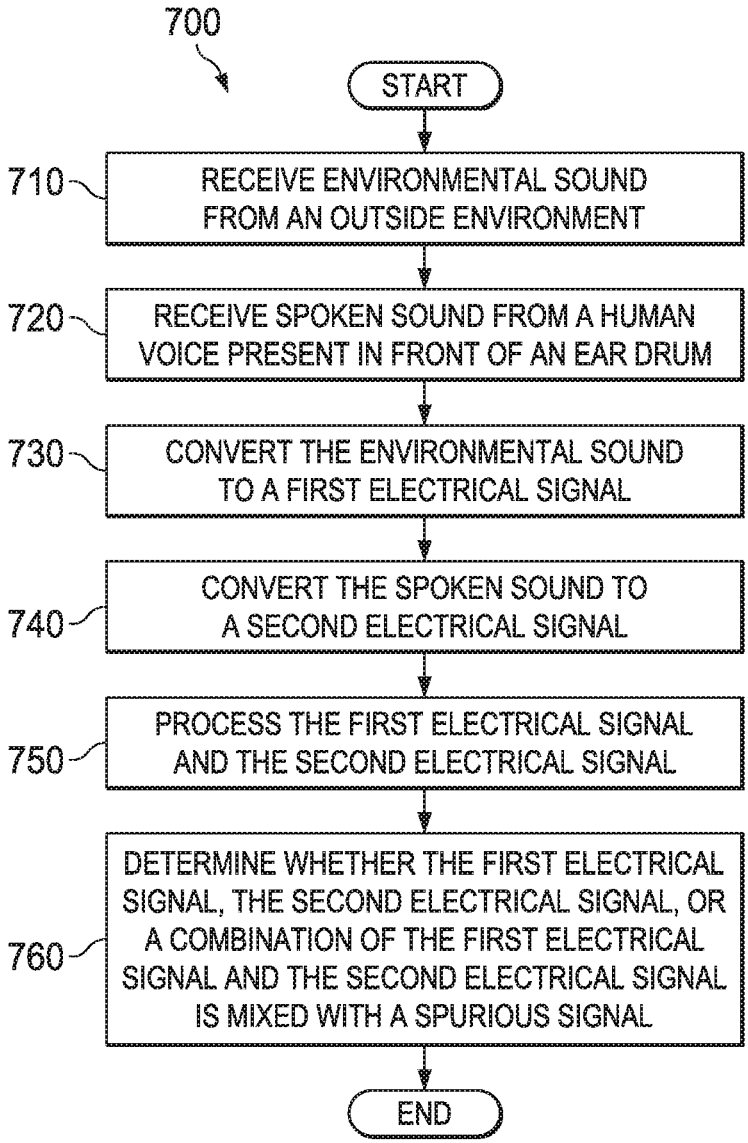
FIG. 7 is a flowchart illustrating a method of determining a spurious signal according to an embodiment of the disclosure.

FIG. 7 is a flowchart illustrating a method 700 of determining a spurious signal according to an embodiment of the disclosure. The system 100 implements the method 700. At step 710, environmental sound is received from an outside environment. For instance, the outer microphone 210 receives the environmental sound. At step 720, spoken sound from a human voice present in front of an ear drum is received. For instance, the inner microphone 230 receives the spoken sound. At step 730, the environmental sound is converted to a first electrical signal. For instance, the outer microphone 210 converts the environmental sound. At step 740, the spoken sound is converted to a second electrical signal. For instance, the inner microphone 230 converts the spoken sound. At step 750, the first electrical signal and the second electrical signal are processed. For instance, the control unit 120 and the failure detection component 310 process the first electrical signal and the second electrical signal. Finally, at step 760, it is determined whether the first electrical signal, the second electrical signal, or a combination of the first electrical signal and the second electrical signal is mixed with a spurious signal. For instance, the control unit 120 and the failure detection component 310 perform the methods 500, 600 to determine whether the first electrical signal, the second electrical signal, or a combination of the first electrical signal and the second electrical signal is mixed with a spurious signal.

In one embodiment, a headset system comprises: a headset comprising at least one microphone and at least one speaker and configured to transmit and receive sound; a wire system coupled to the headset and comprising a wire; and a control unit coupled to the wire system and configured to: receive from the wire a combined signal comprising a first signal and a second signal, determine that the first signal is a spurious signal, and detect a failure of the wire system based on the determining. In some embodiments, the combined signal is an available signal processed during normal operation; the combined signal does not comprise a signal introduced for purposes of the detecting; the spurious signal is an electrical wave whose origin is an undesired electrical event within the headset system; the wire system comprises a power supply wire, and wherein the control unit is further configured to detect the failure in the power supply wire; the wire system comprises an outer microphone wire, and wherein the control unit is further configured to detect the failure in the outer microphone wire; the wire system comprises an inner microphone wire, and wherein the control unit is further configured to detect the failure in the inner microphone wire; the wire system comprises a speaker wire, and wherein the control unit is further configured to further detect the failure in the speaker wire; the control unit is further configured to restrict a function in response to the detecting; the function is active noise reduction (ANR).

In another embodiment, a headset system comprises: a headset comprising: a first outer microphone, a first inner microphone, and a first speaker; a wire system coupled to the headset and comprising: a first power supply wire configured to provide power to the headset, a first outer microphone wire configured to provide communication to and from the first outer microphone, a first inner microphone wire configured to provide communication to and from the first inner microphone, and a first speaker wire configured to provide communication to and from the first speaker and a control unit coupled to the wire system and configured to detect for a failure in the first power supply wire, the first outer microphone wire, the first inner microphone wire, and the first speaker wire. In some embodiments, wherein the control unit is further configured to further detect for the failure by detecting for a spurious signal; the control unit is further configured to generate a warning upon detecting the failure; the control unit is further configured to disable a function of the headset system upon detecting the failure; the control unit is further configured to: receive a first signal from the first outer microphone; receive a second signal from the first inner microphone; determine a first peak value from the first signal; determine a second peak value from the second signal; perform a comparison of the first peak value and the second peak value; and further detect for the failure based on the comparison; the control unit is further configured to: determine that there is a failure in the first power supply wire when an absolute value of a difference between the second peak value and the first peak value is less than a first threshold; determine that there is a failure in the first inner microphone wire when the difference is greater than a second threshold and when the second peak value is greater than a third threshold; determine that there is a failure in the first outer microphone wire when the first peak value is greater than a fourth threshold; and determine that there is a failure in the first speaker wire when the difference is greater than a fifth threshold.

In yet another embodiment, a method implemented in a headset system comprises: receiving environmental sound from an outside environment; receiving spoken sound from a human voice present in front of an ear drum; converting the environmental sound to a first electrical signal; converting the spoken sound to a second electrical signal; processing the first electrical signal and the second electrical signal; and determining whether the first electrical signal, the second electrical signal, or a combination of the first electrical signal and the second electrical signal is mixed with a spurious signal. In some embodiments, the spurious signal is an electrical wave whose origin is an undesired electrical event within the headset system; the method further comprises: receiving the first electrical signal from a first outer microphone in the headset system; receiving the second electrical signal from a first inner microphone in the headset system; determining a first peak value from the first electrical signal; determining a second peak value from the second electrical signal; performing a comparison of the first peak value and the second peak value; and detecting for the spurious signal based on the comparison; the method further comprises: determining that there is a failure in a power supply wire in the headset system when an absolute value of a difference between the second peak value and the first peak value is less than a first threshold; determining that there is a failure in an inner microphone wire of the headset system when the difference is greater than a second threshold and when the second peak value is greater than a third threshold; determining that there is a failure in an outer microphone wire of the headset system when the first peak value is greater than a fourth threshold; and determining that there is a failure in a speaker wire of the headset system when the difference is greater than a fifth threshold.

The use of the term "about" means a range including ±10% of the subsequent number, unless otherwise stated. While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, components, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

What is claimed is:

1. A headset system comprising:

a headset comprising at least one microphone and at least one speaker and configured to transmit and receive sound;

a wire system coupled to the headset and comprising a wire; and a control unit coupled to the wire system and configured to:

receive from the wire a combined signal comprising a first signal and a second signal, determine that the first signal is a spurious signal; and determine a first peak value from the first signal;

determine a second peak value from the second signal;

perform a comparison of the first peak value and the second peak value; and detect a failure of the wire system based on the comparison.

2. The headset system of claim 1, wherein the combined signal is an available signal processed during normal operation.

3. The headset system of claim 2, wherein the combined signal does not comprise a signal introduced for purposes of the detecting.

4. The headset system of claim 1, wherein the spurious signal is an electrical wave whose origin is an undesired electrical event within the headset system.

5. The headset system of claim 1, wherein the wire system comprises a power supply wire, and wherein the control unit is further configured to detect the failure in the power supply wire.

6. The headset system of claim 1, wherein the wire system comprises an outer microphone wire, and wherein the control unit is further configured to detect the failure in the outer microphone wire.

7. The headset system of claim 1, wherein the wire system comprises an inner microphone wire, and wherein the control unit is further configured to detect the failure in the inner microphone wire.

8. The headset system of claim 1, wherein the wire system comprises a speaker wire, and wherein the control unit is further configured to further detect the failure in the speaker wire.

9. The headset system of claim 1, wherein the control unit is further configured to restrict a function in response to the detecting.

10. The headset system of claim 9, wherein the function is active noise reduction (ANR).

11. A headset system comprising:

a headset comprising:

a first outer microphone, a first inner microphone, and a first speaker;

a wire system coupled to the headset and comprising:

a first power supply wire configured to provide power to the headset, a first outer microphone wire configured to provide communication to and from the first outer microphone, a first inner microphone wire configured to provide communication to and from the first inner microphone, and a first speaker wire configured to provide communication to and from the first speaker; and a control unit coupled to the wire system and configured to detect for a failure in the first power supply wire, the first outer microphone wire, the first inner microphone wire, and the first speaker wire, wherein the control unit is further configured to:

receive a first signal from the first outer microphone;

receive a second signal from the first inner microphone;

determine a first peak value from the first signal;

determine a second peak value from the second signal;

perform a comparison of the first peak value and the second peak value; and further detect for the failure based on the comparison.

12. The headset system of claim 11, wherein the control unit is further configured to further detect for the failure by detecting for a spurious signal.

13. The headset system of claim 11, wherein the control unit is further configured to generate a warning upon detecting the failure.

14. The headset system of claim 13, wherein the control unit is further configured to disable a function of the headset system upon detecting the failure.

15. The headset system of claim 11, wherein the control unit is further configured to:

determine that there is failure in the first power supply wire when an absolute value of a difference between the second peak value and the first peak value is less than a first threshold;

determine that there is failure in the first inner microphone wire when the difference is greater than a second threshold and when the second peak value is greater than a third threshold;

determine that there is failure in the first outer microphone wire when the first peak value is greater than a fourth threshold; and determine that there is failure in the first speaker wire when the difference is greater than a fifth threshold.

16. A method implemented in a headset system, the method comprising:

receiving environmental sound from an outside environment;

receiving spoken sound from a human voice present in front of an ear drum;

converting the environmental sound to a first electrical signal;

converting the spoken sound to a second electrical signal;

processing the first electrical signal and the second electrical signal;

determining whether the first electrical signal, the second electrical signal, or a combination of the first electrical signal and the second electrical signal is mixed with a spurious signal; and receiving the first electrical signal from a first outer microphone in the headset system;

receiving the second electrical signal from a first inner microphone in the headset system;

determining a first peak value from the first electrical signal;

determining a second peak value from the second electrical signal;

performing a comparison of the first peak value and the second peak value; and detecting for the spurious signal based on the comparison.

17. The method of claim 16, wherein the spurious signal is an electrical wave whose origin is an undesired electrical event within the headset system.

18. The method of claim 16, further comprising:

determining that there is a failure in a power supply wire in the headset system when an absolute value of a difference between the second peak value and the first peak value is less than a first threshold;

determining that there is failure in an inner microphone wire of the headset system when the difference is greater than a second threshold and when the second peak value is greater than a third threshold;

determining that there is failure in an outer microphone wire of the headset system when the first peak value is greater than a fourth threshold; and determining that there is failure in a speaker wire of the headset system when the difference is greater than a fifth threshold.

* * * * *